US006718693B2

(12) United States Patent
Gleason

(10) Patent No.: US 6,718,693 B2
(45) Date of Patent: Apr. 13, 2004

(54) WINDOW TILT LATCH

(75) Inventor: Robert E. Gleason, Kendallville, IN (US)

(73) Assignee: Newell Industrial Corporation, Albion, IN (US)

( * ) Notice: Subject to any disclaimer, the term of this patent is extended or adjusted under 35 U.S.C. 154(b) by 0 days.

(21) Appl. No.: 10/050,449

(22) Filed: Jan. 16, 2002

(65) Prior Publication Data

US 2002/0116875 A1 Aug. 29, 2002

Related U.S. Application Data

(60) Provisional application No. 60/261,961, filed on Jan. 16, 2001.

(51) Int. Cl.[7] ..... E05D 15/22
(52) U.S. Cl. ..... 49/186; 49/183
(58) Field of Search ..... 49/161, 176, 183, 49/186, 449

(56) References Cited

U.S. PATENT DOCUMENTS

| | | | | | |
|---|---|---|---|---|---|
| 362,714 | A | * | 5/1887 | Bradshaw | 49/186 |
| 2,169,903 | A | * | 8/1939 | Ruehl | 49/186 |
| 3,012,292 | A | | 12/1961 | Brengman | |
| 3,055,062 | A | | 9/1962 | Peters et al. | |
| 3,124,849 | A | | 3/1964 | Osten, Sr. | |
| 3,184,784 | A | | 5/1965 | Peters | |
| 3,197,819 | A | | 8/1965 | Trout | |
| 3,233,278 | A | | 2/1966 | Lundgren | |
| 3,429,071 | A | | 2/1969 | Phillips | |
| 3,434,236 | A | | 3/1969 | Weidner et al. | |
| 3,462,882 | A | | 8/1969 | Brown, Jr. | |
| 3,482,354 | A | | 12/1969 | Trout | |
| 3,524,282 | A | | 8/1970 | Kraft et al. | |
| 3,611,636 | A | | 10/1971 | Trout | |
| 3,676,956 | A | | 7/1972 | Taylor et al. | |
| 3,789,549 | A | | 2/1974 | Yip | |
| 3,797,168 | A | | 3/1974 | Trout | |
| 3,844,066 | A | | 10/1974 | Nobes | |
| 3,861,082 | A | | 1/1975 | Dau | |
| 4,068,406 | A | | 1/1978 | Wood | |
| 4,079,549 | A | | 3/1978 | Wood | |
| 4,227,345 | A | | 10/1980 | Durham, Jr. | |
| 4,271,631 | A | | 6/1981 | Trout | |
| 4,363,190 | A | | 12/1982 | Anderson | |
| 4,364,199 | A | | 12/1982 | Johnson et al. | |
| 4,446,654 | A | | 5/1984 | Schoolman et al. | |
| 4,452,012 | A | | 6/1984 | Deal | |
| 4,506,478 | A | | 3/1985 | Anderson | |
| 4,551,881 | A | | 11/1985 | Hoffman | |
| 4,570,382 | A | | 2/1986 | Suess | |
| 4,610,108 | A | | 9/1986 | Marshik | |
| 4,644,691 | A | | 2/1987 | Wright | |
| 4,683,675 | A | | 8/1987 | Guelck | |
| 4,683,676 | A | | 8/1987 | Sterner, Jr. | |
| 4,887,389 | A | | 12/1989 | Haltof | |
| 4,955,159 | A | * | 9/1990 | Rogers | 49/161 |
| 6,026,617 | A | | 2/2000 | Stark | |
| 6,141,913 | A | * | 11/2000 | Wong et al. | 49/183 |

* cited by examiner

*Primary Examiner*—Jerry Redman
(74) *Attorney, Agent, or Firm*—Price, Heneveld, Cooper, DeWitt & Litton, LLP

(57) ABSTRACT

An invertably mountable device having a generally hollow housing which mounts a movable latch member that is preferably biased toward latching engagement with an adjacent window jamb liner by a spring disposed within the housing. The housing preferably comprises a pair of mirror-image shells which fit together to form an enclosure, and provide an internal pivot mount for the latch member, and the housing has an opening through which the latch member projects. The latch member preferably carries a finger grip/thumb abutment member which facilitates movement of the latch member by an operator, and the grip/abutment member and latch member are preferably configured to permit mounting of the grip/abutment on either side of the latch member, to facilitate invertable mounting of the latch member. The latch member and jamb liner preferably provide a detent structure for secure interengagement.

20 Claims, 5 Drawing Sheets

WINDOW TILT LATCH

CROSS REFERENCE TO RELATED APPLICATION

The present invention claims priority to Provisional Patent Application Ser. No. 60/261,961, filed on Jan. 16, 2001 entitled WINDOW TILT LATCH.

FIELD OF THE INVENTION

This invention relates generally to windows and window-mounting apparatus, and more particularly to vertically slidable windows such as the type generally known as "single-hung" or "double-hung" window units, including the jamb liners in which they are slidably mounted. More particularly still, the invention relates to slidable windows of the general type just noted which are mounted to be pivotally tiltable away from their jamb liners for ease of cleaning, etc.

BACKGROUND

Tiltable or "take-out" type windows were developed many years ago and are well known in the art, having become favored by homeowners and the like for the convenience which they provide in cleaning, replacement, etc. This is particularly true in the case of "double-hung" windows, which have two slidable window sash at each window location, i.e., an upper sash and a lower sash which are each slidably mounted in mutually adjacent parallel planes. In order to facilitate the desired pivotal tilt movement of such windows, specially shaped jamb liner profiles have been developed which make it easier for the sides of the sash to be pulled out of their normal position in the jamb liner and moved pivotally in a direction perpendicular to and angularly relative to their normal plane of sliding motion, usually by pivoting about the bottom end extremity of the sash. For example, the portions of the sash sides (stiles) which normally project into jamb liner channels (or the sash side grooves or "ploughs" which normally receive a projecting ridge or rib formed on the jamb liner) may be reduced in height or depth as much as possible to correspondingly minimize the extent to which the jamb liner must be forced laterally outward by the sash stiles when the sash is pivoted and moved away from the jamb liners to tilt the sash, such movement of the jamb liners typically being enabled through the use of a resiliently compressible foam or the like disposed between them and the rigid sides of the window frames in which they are mounted. Other such tilt-facilitating configurations include the provision of angular engagement surfaces between the window sash stiles and jamb liner channels, rather than surfaces which are essentially parallel to the plane of the window sash itself, which is perpendicular to the necessary path of movement which the window sash must follow when pivoting outwardly.

While such measures do facilitate the angular disengagement of the window sash from the jamb liner, so that it requires less physical effort to tilt the sash in the desired manner while cleaning, etc., they also inherently decrease the amount of force necessary to unintentionally displace the windows from the jamb liners, as for example by high-level wind forces during storms and the like. This is particularly true in the case of double-hung windows, in which the upper cross-member (top) rail of the lower window unit is disposed laterally adjacent the lower cross-member (bottom) rail of the upper window unit, at the center of the window, when both sash are fully closed (a location known as the "check rail"). This location then becomes the weakest point in the window unit with respect to resisting wind forces and other such disrupting factors. As a result, abrupt and highly undesirable window failures can occur during storms or high-level winds, when the window sash units are violently and forcibly blown out of their jamb liners and into the adjoining room space, allowing the wind and rain of the storm to enter the room and usually smashing or violently splintering the window units at the same time.

BRIEF SUMMARY OF THE INVENTION

The present invention provides a solution for the problem noted above, permitting use of the tilt-facilitating jamb liner/window sash configurations which have been developed over time by providing a positive and reliable window sash interlock means which will positively retain the sash in place regardless of ambient wind forces and the like. Further, the invention provides a selectively controllable interlock means for tilt-type or takeout-type windows, by which the window units remain locked in place against disrupting forces unless and until tilting is desired, at which time a simple and easy manual effort releases the interlock to permit the desired tilting motion of the sash.

Accordingly, the invention provides a selectably actuable interlock for sliding windows which comprises a housing which is mounted upon the sash, preferably at the check rail, with a readily releasable latch member mounted in or upon, and carried by, the housing, preferably biased in a direction which maintains engagement of the latch member with a corresponding wall surface of the adjoining jamb liner, to provide a secure interlock between the sash and jamb liner that precludes undesired release of the sash from the jamb liner for tilting motion but readily permits such release and tilting motion when desired, all without adversely affecting the other operational aspects of the window, such as its sliding motion.

DESCRIPTION OF THE PREFERRED EMBODIMENTS

Figure 1:
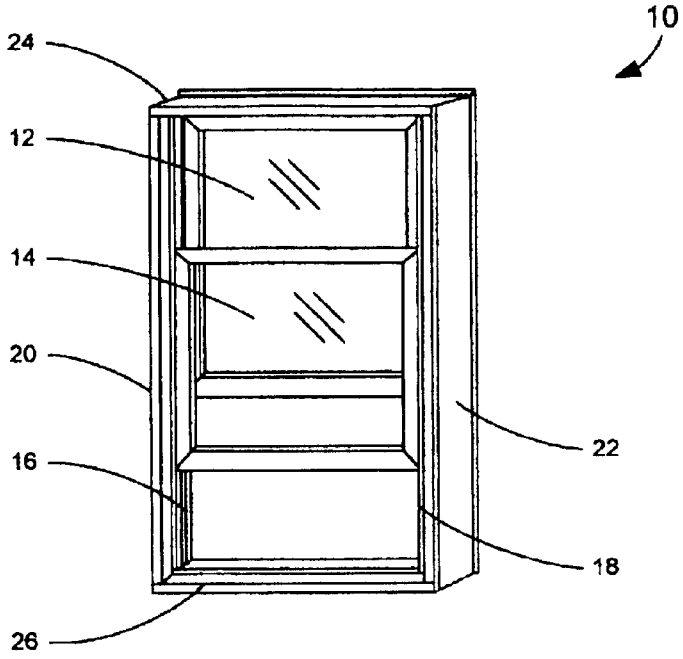
FIG. 1 is a perspective view generally illustrating a typical double-hung window installation.

Referring now in more detail to the drawings, a typical double-hung window installation 10 is shown in FIG. 1 for purposes of illustration. As shown, window unit 10 includes an upper sash 12 and lower sash 14, which are each mounted for vertical movement adjacent one another in generally parallel planes. Each such sash unit is mounted for sliding movement between a pair of jamb liners 16, 18, and these are typically secured in place between vertically extending side frame members 20, 22 of the building structure involved, which also includes upper and lower frame members 24, 26. As will be understood, the basic elements of window unit 10, as generally illustrated in FIG. 1 and as just described, are all conventional and well known.

Figure 2:
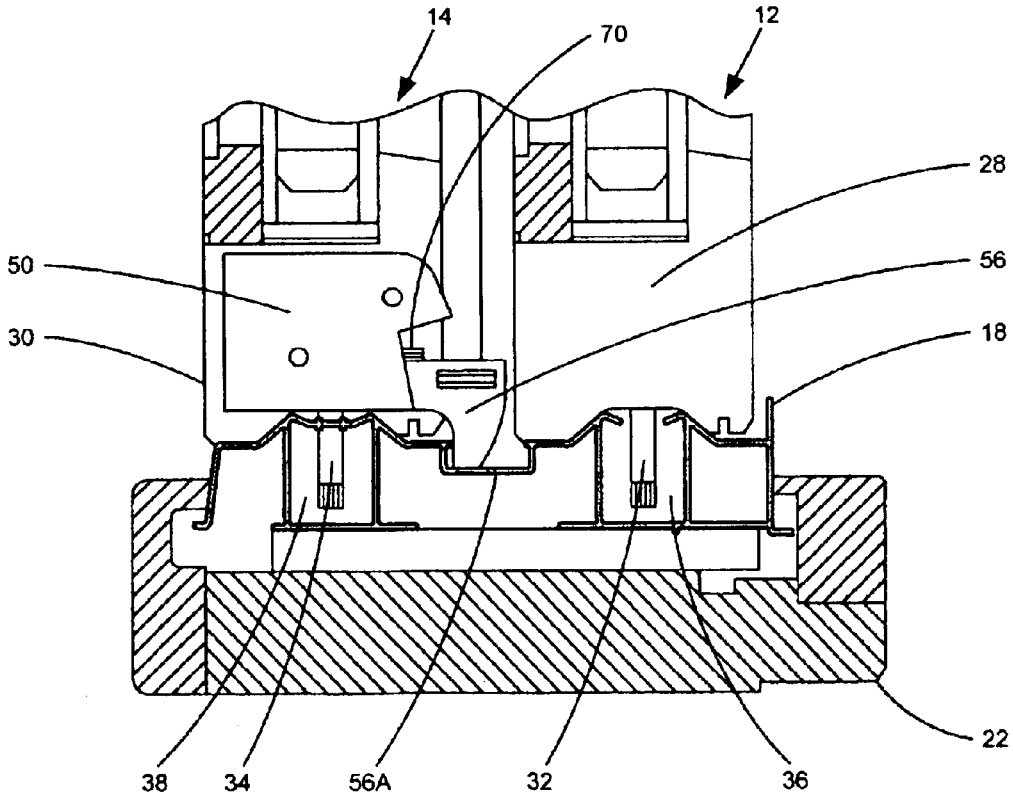
FIG. 2 is a fragmentary, enlarged cross-sectional view taken along the plane II—II of FIG. 1 and viewed in the direction of the arrows.

The side (edge) configuration and manner in which the sides of the upper and lower sash 12, 14 engage jamb liners 16, 18 in a preferred embodiment of the invention is illustrated in FIG. 2, wherein a modified conventional jamb liner profile is depicted to better illustrate the general environment of the present invention. As there illustrated, the side extremities or stiles 28, 30 of the upper and lower sash 12, 14, are disposed in flush, contiguous surface contact with the adjacent surface of the jamb liner 18, upon which they slide when their respective sash units are moved upwardly or downwardly to open or close the window. Each such sash typically has a pivot pin 32, 34 projecting laterally outwardly from each side, at the bottom thereof, into a generally square or rectangular channel area 36, 38 of the jamb liner, in which a slidable positioner member (not shown) is typically located, by which each such window sash member is retained in its various possible positions of vertical adjustment resulting from varying degrees of slidable motion along the jamb liners 16, 18 in opening and closing the window sash. As will be understood, when either such sash unit is tilted, or pivoted, for cleaning or the like, the pivotal motion takes place around the axis of pivot pins 32, 34, which are received within a corresponding bore or recess in the positioner member with which they are engaged.

Figure 7:
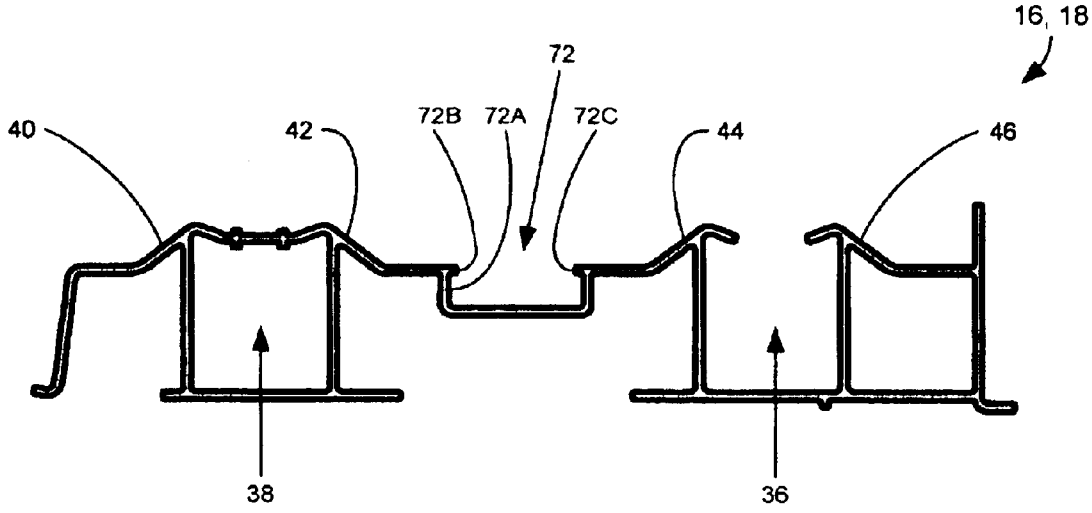
FIG. 7 is an enlarged, sectional end view of a preferred jamb liner profile for use with the novel interlock latch apparatus of the invention.

With further reference to FIG. 2, and also to FIG. 7, the profile of jamb liner 18 (and also of jamb liner 16, which is essentially identical but a mirror-image of jamb liner 18) is angularly disposed at areas designated 40, 42, 44, 46 to facilitate release or disengagement of the corresponding window sash edge for tilt-out of the sash. This in effect provides an inclined plane upon which such sash movement may occur, rather than an abrupt perpendicular abutment as would otherwise be true in a typical jamb liner, particularly a non-takeout-type jamb liner. As explained above, however, while having such angular sash-to-jamb liner engagements does facilitate sash release for tilt or takeout, it also may reduce the extent to which the window unit can resist strong exterior forces such as wind-loading and the like, and this car result in disastrous blowout (actually, blow-in) of the window sash units during storms and the like. The novel interlock apparatus 50 of the present invention provides a solution for this problem in a very desirable and effective manner.

Figure 3:
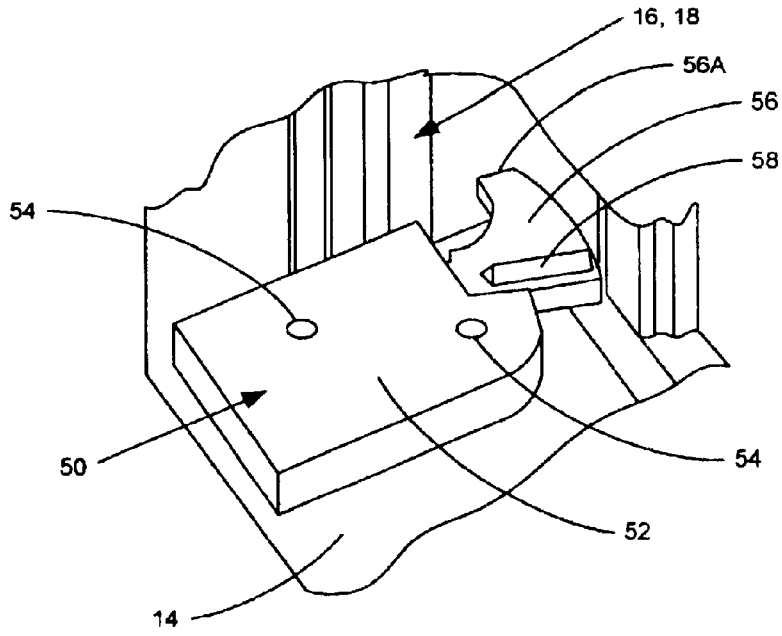
FIG. 3 is a further enlarged fragmentary perspective view showing the interlock apparatus of the invention mounted atop a window sash unit, with the latch member in a retracted position.
Figure 4:
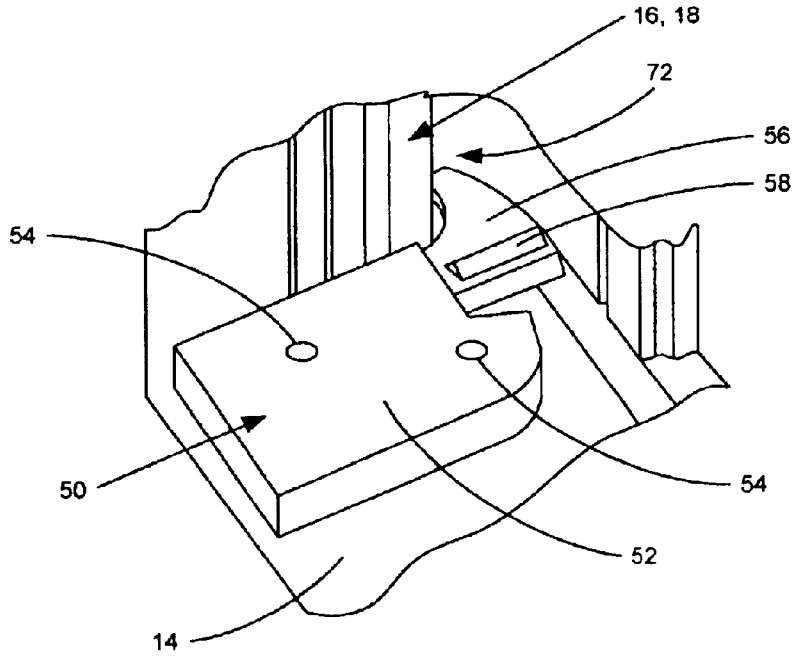
FIG. 4 is an enlarged, fragmentary view like FIG. 3 but showing the latch member in a non-retracted, engaged position.

As illustrated in FIG. 2, and further illustrated in FIGS. 3 and 4, the novel interlock apparatus 50 of the invention preferably mounts atop the lower window sash unit 14, on the top rail thereof which extends between sides 28 and 30, at each outer edge thereof, directly adjacent the jamb liners 16, 18. Each such interlock apparatus 50 includes a base or housing portion 52, which preferably includes a transverse passage 54 for receiving an attachment screw or the like, by which the apparatus 50 may be secured in place atop the sash 14. Interlock apparatus 50 also includes a manually actuable latch member 56, which is mounted for movement between two opposite positions. In one such position, the end extremity of latch member 56 engages behind a corresponding surface of jamb liner 16, 18 (FIG. 4), to interlock the sash and jamb liner and in the other such position the latch member is retracted away from that interlocking position (FIG. 3). To facilitate easy manual actuation, the latch member 56 preferably includes an outwardly extending thumb abutment 58.

Figure 5:
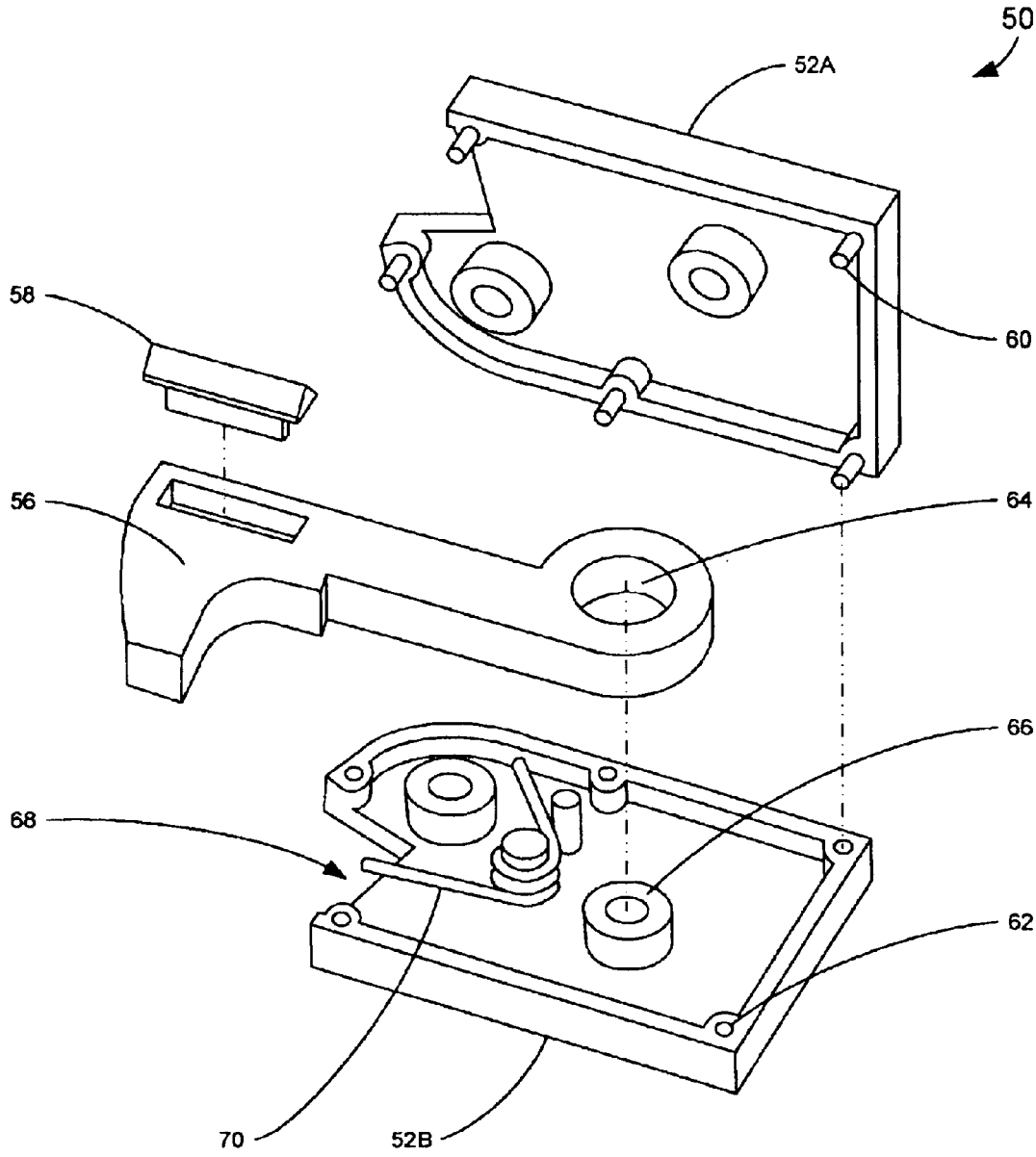
FIG. 5 is a further enlarged, exploded view showing the parts and structure of the interlock apparatus in a disassembled state.
Figure 6:
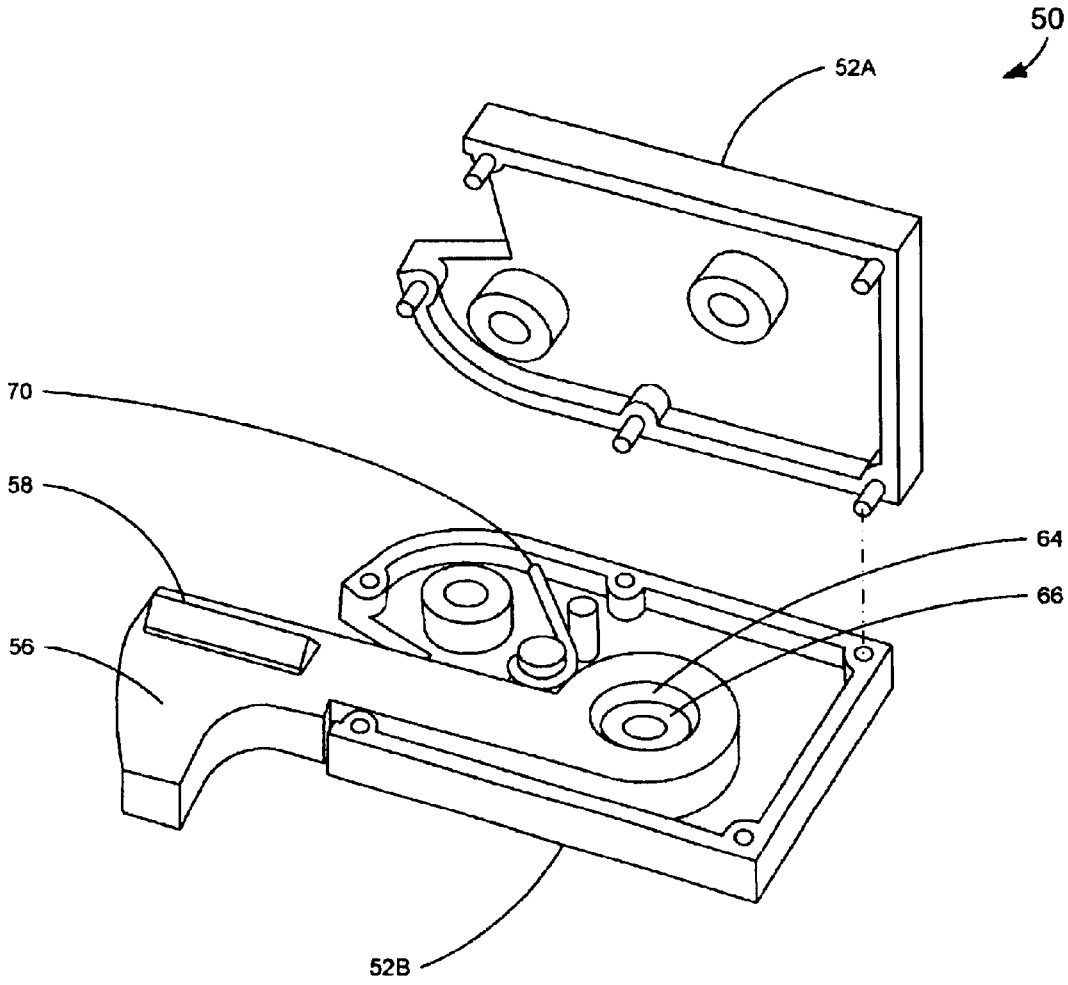
FIG. 6 is an exploded view similar to FIG. 5, on a somewhat reduced scale, with the latch member mounted in place.

The structural details of a preferred embodiment for the interlock apparatus 50 are illustrated in FIGS. 5 and 6. As shown there, the base/housing 52 preferably comprises a pair of oppositely configured mutually engageable shell-like sides 52*a*, 52*b*, which fit together by interengagement of the illustrated pins 60 and recesses 62, formed integrally with the housing portions 52*a*, 52*b*. The assembled or mutually engaged housing portions 52*a*, 52*b* together define a generally hollow enclosure in which the latch member 56 is mounted (FIG. 6). Preferably, latch member 56 is pivotally and invertably mounted within housing 52 by an integrally formed pivot recess 64 in the latch member (FIG. 5) and a corresponding hub or boss 66 in the housing, which fit together in a slidably rotatable manner, illustrated in FIGS. 5 and 6. As so mounted, latch member 56 is invertable for both left-hand and right-hand mounting of the device, on either side of the window, with a jamb-engagement portion projecting longitudinally out of housing 52, through an open area 68 thereof which provides clearance for movement of the latch member 56 between two opposite positions, i.e., those illustrated in FIGS. 3 and 4 and described briefly above. This pivotal movement is preferably biased by a torsion spring 70, which urges the pivotal latch member 56 toward the engaged position shown in FIG. 4. Of course, this engagement bias is readily overcome by manually-exerted pressure against a finger, grip or thumb abutment 58, by which latch member is retracted away from the adjacent jamb liner 16 or 18, to release it therefrom (as shown in FIG. 3). As will be understood, one end extremity of torsion spring 70 bears against the inside surface of housing 52*b*, while the opposite end extremity thereof bears against the adjacent side of latch member 56, thereby biasing it toward its position of engagement (also shown in FIG. 6).

In the most preferred embodiment of the invention, the engagement of latch member 56 and the adjacent one of the jamb liners 16, 18 occurs in the area of a recessed portion 72 provided in jamb liner 16, 18 (FIGS. 2, 4, and 7), which provides a convenient recess for the projecting end extremity 56*a* of latch member 56. In its most preferred form, this projecting end extremity 56*a* of latch member 56 is somewhat hook-like in configuration, i.e., the underside thereof is at least slightly curved, preferably along an arc corresponding to the pivot radius of latch 56 about hub 66. By so configuring this end extremity 56*a*, it will not only engage within the jamb liner recess portion 72, but actually hook behind and against portion 72*a* thereof (FIG. 7), and it is to be noted that a projecting ridge or rib-like edge 72*b*, 72*s* is preferably incorporated into and at the end extremity of recess side wall 72*a*, extending longitudinally along the jamb liner surface. This provides a desirable detent behind the extending tip portion 56*a* of latch 56 which serves to enhance the engagement between the latch member and jamb liner, and thereby increase the corresponding retention of the window sash unit in resisting undesired disturbance forces such as wind and the like. In this respect, the advantage provided by the preferred arcuate shape of the underside of projecting latch portion tip 56*a* will be better appreciated, particularly in connection with the most preferred arcuate configuration corresponding to the pivot radius of latch member 56.

As will now be understood, the invention provides a simple, inexpensive but highly effective solution for the problem of window blowout or unintended release described above, whereby the secure retention of each window sash unit is substantially augmented while at the same time providing for easy and convenient sash disengagement to permit the desired pivot or tilt motion of the sash unit for cleaning, etc. In this regard, retention of only one of the two sash units 12, 14 at the check rail location will also help retain the other such sash unit in place, since the two sash units typically overlap at the check rail and the upper (and typically outer) sash cannot move inwardly if the lower sash is retained securely in place. Of course, each such sash unit may carry its own separate interlock apparatus, for more positive securement of each window sash while at the same time providing separate, selective latch disengagement for each window unit, as may be desired.

As one further point, it is to be noted that the body/housing body portions 52*a* and 52*b* are preferably manufactured as mirror-image parts, so that the interlock assembly 50 may be mounted at either side of the window sash check rail, i.e., either side of the interlock apparatus may be placed against and secured atop the same sash unit by selectively inverting the housing. To facilitate this reversible single-assembly capability, the latch member 56 is reversibly (invertably) mountable within housing 52, and finger grip thumb abutment 58 is preferably made as a separate part which may be assembled in place upon the latch member 56 on either side, as by a projecting tongue and recess arrangement, as illustrated, which permits the grip/abutment 58 to be attached to either side of the latch member 56, according to its position atop the window sash unit.

Thus, the preferred embodiments of this invention offer the following features:

- a window sash interlock assembly for secure retention of a slidable window sash with respect to the jamb liner or analogous device in which it is slidably mounted;
- a window sash interlock assembly as noted above, having a manually releasable interlock element;
- a window sash interlock assembly as noted above, having a manually releasable latch member;
- a window sash interlock assembly as noted above, having a movable latch member with an end configuration that hooks over a corresponding part of the jamb liner;
- a window sash interlock assembly as noted in the preceding paragraph, wherein the latch member hooking and configuration includes a curved surface;
- a window sash interlock assembly as noted in the previous paragraph, wherein the latch member is pivotally mounted and the curved surface is complementary to the pivot radius of the latch member;
- a window sash interlock assembly as noted in any of the preceding paragraphs, wherein the jamb liner is shaped to form a detent with the latching member;
- a window sash interlock assembly as noted in any of the preceding paragraphs, wherein the jamb liner has at least one ridge to augment engagement by the latch member;
- a window sash interlock assembly as noted in any of the preceding paragraphs wherein the end configuration of the latch member and the shape of the corresponding part of the jamb liner define a detent arrangement;
- a window sash interlock assembly which includes a movable latch member which is resiliently biased to normally remain in its latched position;
- a window sash interlock assembly comprising a self-contained unit which is mountable upon a window sash and carried therewith during movement of the sash from one position to another; and
- a window sash interlock assembly comprising an invertably mountable dual-purpose device attachable to either side of a window sash unit.

The above description is considered that of the preferred embodiments only. Modifications and variations of this and other such embodiments may well occur to those skilled in the art and to those who make or use the invention after learning of it through access to such preferred embodiments. Accordingly, it is to be understood that the embodiments shown in the drawings and described above are merely for illustrative purposes and should not be used to limit the scope of the invention, which is generally defined by the appended claims, which are to be interpreted according to the principles of patent law, including the doctrine of equivalents.

The invention claimed is:

1. A window assembly including a pair of mutually opposed jamb liners and a sash positionable between the jamb liners with opposite sides of the sash slidably engaged with the jamb liners, said window assembly comprising:

a latch member having a body with a protruding jamb-engagement portion and a mounting portion spaced from said jamb-engagement portion;

said body having a size and shape to be operably mounted upon said sash in a position generally orthogonal with respect to and generally adjacent to at least one of said opposed jamb liners, and said mounting portion defining a pivot mount by which said jamb-engagement portion may be pivoted toward and away from said one generally adjacent jamb liner;

said protruding jamb-engagement portion having a size and shape to interfit with and retentively index behind a surface portion of said jamb liner when pivoted toward it, to thereby prevent unintended movement of the sash laterally away from the jamb liner in the vicinity of the interlock device;

said pivot mount providing for pivotal movement of said jamb-engagement portion away from said jamb liner to free said sash for disengagement from said jamb liner and thereby enable angular tilting movement of the sash with respect to said jamb liner; and wherein:

said sash defines vertical opposed side faces, and said jamb liners include, in cross-section, first and second angularly disposed surfaces extending generally towards the sash and towards one another to define a vertically elongated raised guide portion positioned between said side faces, said opposite sides of said sash including at least one surface configured to slidably engage at least a selected one of said first and second angularly disposed surfaces to permit vertical sliding of said sash along said raised guide portion.

2. The window assembly of claim 1, wherein said protruding jamb-engagement portion comprises a hook element.

3. The window assembly of claim 1, further including a housing which encloses at least portions of said latch member.

4. The window assembly of claim 1, including a finger grip on said latch member to facilitate manual movement of said member toward or away from said jamb liner.

5. The window assembly of claim 4, wherein said protruding jamb-engagement portion comprises a hook element.

6. The window assembly of claim 5, wherein said hook element has a curved surface shaped to hook round a portion of said jamb liner.

7. The window assembly of claim 5, further including a housing which encloses at least portions of said latch member.

8. The window assembly of claim 7, including a resilient biasing element operably disposed between said housing and said latch member to urge the latch member toward said jamb liner.

9. An interlock device for retaining a window sash in place between a pair of mutually opposed jamb liners with which opposite sides of the sash are slidably engaged, comprising:

a latch member having a body with a protruding jamb-engagement portion and a mounting portion spaced from said jamb-engagement portion;

said body having a size and shape to be operably mounted upon said sash in a position generally orthogonal with respect to and generally adjacent to at least one of said opposed jamb liners, and said mounting portion defining a pivot mount by which said jamb-engagement portion may be pivoted toward and away from said one generally adjacent jamb liner;

said protruding jamb-engagement portion having a size and shape to interfit with and retentively index behind a surface portion of said jamb liner when pivoted toward it, to thereby prevent unintended movement of the sash laterally away from the jamb liner in the vicinity of the interlock device;

said pivot mount providing for pivotal movement of said jamb-engagement portion away from said jamb liner to free said sash for disengagement from said jamb liner and thereby enable angular tilting movement of the sash with respect to said jamb liner; and wherein:

said hook element has a curved surface shaped to hook around a portion of said jamb liner.

10. An interlock device for retaining a window sash in place between a pair of mutually opposed jamb liners with which opposite sides of the sash are slidably engaged, comprising:

a latch member having a body with a protruding jamb-engagement portion and a mounting portion spaced from said jamb-engagement potion;

said body having a size and shape to be operably mounted upon said sash in a position generally orthogonal with respect to and generally adjacent to at least one of said opposed jamb liners, and said mounting portion defining a pivot mount by which said jamb-engagement portion may be pivoted toward and away from said one generally adjacent jamb liner;

said protruding jamb-engagement potion having a size and shape to interfit with and retentively index behind a surface portion of said jamb liner when pivoted toward it, to thereby prevent unintended movement of the sash laterally away from the jamb liner in the vicinity of the interlock device;

said pivot mount providing for pivotal movement of said jamb-engagement portion away from said jamb liner to free said sash for disengagement from said jamb liner and thereby enable angular tilting movement of the sash with respect to said jamb liner;

a housing which encloses at least portions of said latch member;

a resilient biasing element operably disposed between said housing and said latch member to urge the latch member toward said jamb liner.

11. A window assembly including a window sash and an interlock device for retaining the window sash in place between a pair of mutually opposed jamb liners with which opposite sides of the sash are slidably engaged, said window assembly comprising:

a latch member having a body with a protruding jamb-engagement portion and a mounting portion spaced from said jamb-engagement portion;

a housing which encloses portions of said latch member including said mounting portion thereof, at least said jamb-engagement portion of said latch member projecting out of said housing; and a pivot mount structure for at least one of said latch member and housing, whereby at least said latch member is pivotally movable in a plane; and wherein:

said window sash defines first and second opposed vertical side faces and at least a portion of said jamb-engaging portion of said latch member is positionable in a laterally offset position outside said first side face when engaging said jamb.

12. The window assembly of claim 11, wherein said resilient biasing member is disposed inside said housing.

13. The window assembly of claim 12, wherein said resilient biasing member comprises a spring.

14. The window assembly of claim 11, wherein said latch member has a finger grip/thumb latch which is manually accessible from outside said housing.

15. A window assembly including a window sash and an interlock device for retaining the window sash in place between a pair of mutually opposed jamb liners with which opposite sides of the sash are slidably engaged, said window assembly comprising:

a latch member having a body with a protruding jamb-engagement portion and a mounting portion spaced from said jamb-engagement portion;

a housing which encloses portions of said latch member including said mounting portion thereof, at least said jamb-engagement portion of said latch member projecting out of said housing;

a pivot mount structure for at least one of said latch member and housing, whereby at least said latch member is pivotally movable in a plane;

a resilient biasing member disposed within said housing and acting on said latch member to urge it in one direction of its pivotal movement; and wherein:

said window sash defines first and second opposed vertical side faces and at least a portion of said jamb-engaging portion of said latch member is positionable in a laterally offset position outside said first side face when engaging said jamb.

16. The window assembly of claim 15, wherein said mounting portion of said latch member comprises a part of said pivot mount structure.

17. The window assembly of claim 16, wherein said housing has an internal hub providing a pivot mount and said mounting portion of said latch member comprises a recess which pivotably receives said pivot mount.

18. In combination, first and second window sashes having oppositely disposed sides slidably mounted between a pair of spaced jamb liners, and an interlock device for retaining at least a selected one of said first and second sashes in place as so mounted, said sash member having a top rail extending between said sides, and said interlock device mounted on said top rail generally adjacent one of said jamb liners; said jamb liners including vertically extending connector portions positioned between said first and second sashes; said interlock device having a latch member mounted for pivotal movement toward and away from said generally adjacent jamb liner and said latch member having a projecting interlock portion which is movable into engagement with said connector portion of said jamb liner upon pivotal movement of said latch member toward said jamb liner, said engagement securing said sash to said jamb liner to retain the sash in mounted engagement with respect to the jamb liner, and said latch member being slidable along the jamb liner while so engaged with it to permit sliding movement of the sash along the jamb liner with the latch member and jamb liner so engaged.

19. The combination recited in claim 18, wherein said connecting portion of said jamb liner includes a ridged portion extending along its length and positioned to enable at least part of said projecting interlock portion of said latch member to enhance secure interengagement of said latch member and jamb liner.

20. The combination recited in claim 19, wherein said latch member is at least partially enclosed within a housing.

* * * * *